US009268286B2

(12) United States Patent
Bayer et al.

(10) Patent No.: US 9,268,286 B2
(45) Date of Patent: Feb. 23, 2016

(54) PRINTING ARRANGEMENT FOR TWO-SIDED PRINTING ON A RECORDING MEDIUM AND PRINTING METHOD

(71) Applicant: Océ Printing Systems GmbH & Co. KG, Poing (DE)

(72) Inventors: Andreas Bayer, Poing (DE); Alexander Breitenbach, Graefelfing (DE); Stefan Roehl, Munich (DE); Christian Kopp, Planegg (DE); Andrae le Coutre, Markt Schwaben (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/166,312

(22) Filed: Jan. 28, 2014

(65) Prior Publication Data

US 2014/0212632 A1 Jul. 31, 2014

(30) Foreign Application Priority Data

Jan. 30, 2013 (DE) ..... 10 2013 201 549

(51) Int. Cl.

| | |
|---|---|
| ***G03G 21/20*** | (2006.01) |
| ***G03G 15/23*** | (2006.01) |
| ***G03G 15/10*** | (2006.01) |
| ***G03G 15/00*** | (2006.01) |

(52) U.S. Cl.

CPC ..... *G03G 15/6529* (2013.01); *G03G 15/235* (2013.01); *G03G 21/20* (2013.01); *G03G 15/101* (2013.01); *G03G 2215/1666* (2013.01); *Y10T 428/24802* (2015.01); *Y10T 428/24934* (2015.01)

(58) Field of Classification Search

CPC ..... G03G 15/235; G03G 15/101; G03G 2215/1666; G03G 15/23; G03G 15/10; G03G 21/20; Y10T 428/24802; Y10T 428/24934

USPC ..... 428/195.1, 211.1, 195, 1; 399/364

See application file for complete search history.

(56) References Cited

U.S. PATENT DOCUMENTS

| | | | |
|---|---|---|---|
| 5,140,377 | A | 8/1992 | Lewis |
| 7,848,668 | B2 | 12/2010 | Condello et al. |
| 7,890,043 | B2 | 2/2011 | Biegelsen et al. |

(Continued)

FOREIGN PATENT DOCUMENTS

| | | |
|---|---|---|
| DE | 2003 992 | 10/1970 |
| DE | 197 55 584 | 6/1999 |

(Continued)

OTHER PUBLICATIONS

German Office Action for Application No. 10 2013 201552.6 dated Jul. 15, 2013.

(Continued)

*Primary Examiner* — Bruce H Hess

(74) *Attorney, Agent, or Firm* — Jenkins, Wilson, Taylor & Hunt, P.A.

(57) ABSTRACT

A printing arrangement and a printing method for two-sided printing on a recording medium are disclosed, in which conditioning by steam and/or liquid droplets takes place after printing on the first side of the recording medium. Because of the conditioning, damage is avoided to the print image of the first side during subsequent printing on the second side, without the recording medium being impaired by the conditioning.

9 Claims, 4 Drawing Sheets

(56) References Cited

U.S. PATENT DOCUMENTS

| | | | |
|---|---|---|---|
| 2011/0150534 | A1 | 6/2011 | Kopp |
| 2012/0287450 | A1 | 11/2012 | Nishi |
| 2014/0212631 | A1 | 7/2014 | Bayer |

FOREIGN PATENT DOCUMENTS

| | | |
|---|---|---|
| DE | 103 01 587 | 8/2004 |
| DE | 10 2004 009 987 | 10/2005 |
| DE | 20 2004 020 953 | 5/2006 |
| DE | 10 2008 048 256 | 4/2010 |
| DE | 10 2009 060 334 | 6/2011 |
| DE | 10 2010 015 985 | 9/2011 |
| JP | 2006 350 263 | 12/2006 |
| WO | WO 2005/083528 | 9/2005 |

OTHER PUBLICATIONS

German Office Action for Application No. 10 2013 201 549.6 dated Nov. 11, 2013.

Restriction Requirement for U.S. Appl. No. 14/166,163 dated Jan. 23, 2015.

Non-Final Office Action for U.S. Appl. No. 14/166,163 dated Jun. 1, 2015.

PRINTING ARRANGEMENT FOR TWO-SIDED PRINTING ON A RECORDING MEDIUM AND PRINTING METHOD

CROSS-REFERENCE TO RELATED APPLICATION

This application claims the benefit of and priority to German Patent Application No. 10 2013 201 549.6 filed Jan. 30, 2013, the entire disclosure of which is herein incorporated by reference.

TECHNICAL FIELD

The present invention relates to a printing arrangement for two-sided printing on a recording medium and to a printing method.

BACKGROUND

The invention relates to a printing arrangement for two-sided printing, also referred to as a duplex printing device. In particular, the invention relates to a digital printer for printing on a recording medium using particles, in particular toner particles, which are applied by a liquid developer, in particular a high-speed printer for printing on recording media in web or sheet form.

Exemplary digital printers are known for example from DE 10 2010 015 985 A1, DE 10 2008 048 256 A1 or DE 10 2009 060 334 A1.

Two-sided printing, as for example in the case of two-sided duplex printing, in a printing system with subsequent combined fixing of the printed image on a first side and a second side opposite the first side, that is to say the front and back, of a recording medium is associated with significant problems when the front, which is printed first, is fed, after printing, directly to one or more printing units for printing on the back.

The greatest technical problem in this connection is that of finally feeding the print image, which is located on the front and which has not yet been fixed, to fixing without damaging the print image and with simultaneous printing on the back.

The unfixed print image on the recording medium, for example a printing substrate web, can be remobilised at any time under the effect of an electric field, as used for example in a printing unit of a duplex printing apparatus. In duplex printing, the printed image, for example a toner image, can on one hand be drawn onto the back of the recording medium by the electric field present between transfer roller and pressure roller (back roller). On the other hand, the already transferred print image of the front can be removed from the recording medium. In addition to damage to the print image, this also results in soiling of the pressure roller.

In general there is the option of intermediate fixing (thermally, by pressure, by solvent, infrared, flashlight, etc.), but this is associated with other drawbacks. Furthermore, it is usually not economical to use two fixing stations. In the case of thermal fixing, the recording medium which is dehumidified after fixing causes problems in terms of printability. Furthermore, the recording medium may shrink, for example in the case of paper and cardboard. In addition, print fixing can then lead to a change in the gloss.

DE 197 55 584 A1 for example thus describes melting the toner for fixing the intermediate image by a gas having a temperature between 150° C. and 400° C., and this can lead to the problems indicated above. Also, relatively large quantities of steam in the range of 160 l/sec are used for the method described therein.

Similar methods are described in U.S. Pat. No. 5,140,377 A, DE 2003 992 A1 and DE 103 01 587 A1.

DE 20 2004 020 953 U1 also deals with fixing a toner on a recording medium, and also explicitly addresses the problem of shrinkage of the recording medium. Since this problem is considered unavoidable in the solution described therein, a correction apparatus is proposed in order for the shrinkage not to have a negative effect on the ratio of the printing on the front and back of the recording medium.

An alternative fixing method is also known from DE 10 2004 009 987, in which the fixing takes place by a polymer film. However, this requires an additional application of material and also greater complexity in terms of machinery.

SUMMARY

The object of the present invention is to allow improved two-sided printing on a recording medium.

According to the invention, this object is achieved by a printing arrangement, a printing method, and a recording medium according to the disclosure herein.

In this connection, the printing arrangement comprises at least one simplex printing apparatus which is designed to print on a recording medium having two opposing faces, on a first side of the recording medium, at least one duplex printing apparatus which is designed to print on a second side of the recording medium, which is opposite the first side printed on by the simplex printing apparatus, and a conditioner which is arranged between the simplex printing apparatus and the duplex printing apparatus and which is designed to expose the first side of the recording medium, printed on by the simplex printing apparatus, to liquid droplets and/or steam.

In addition, the invention relates in a further aspect to a printing method for two-sided printing on a recording medium, in which method two opposing sides of a recording medium are printed on, in particular by the printing arrangement according to the invention, comprising the following steps:

- providing at least one simplex printing apparatus, at least one duplex printing apparatus and a recording medium to be printed on;
- printing on a first side of the recording medium using the simplex printing apparatus;
- conditioning/exposing the first side of the recording medium, printed on by the simplex printing apparatus, using liquid droplets and/or steam; and
- printing on a second side of the recording medium, which second side is arranged opposite the first side which has been printed on by the simplex printing apparatus and treated, using the duplex printing apparatus.

In a further aspect, the invention also relates to a recording medium produced by the method according to the invention.

The invention is based on a method and on a device for conditioning a recording medium, such as a printing substrate web, for back printing—printing on the second side—in a two-sided printing method. The aim is to influence the simplex print image located on the front/first side in such a way that it remains as undamaged as possible on the front in the case of an electrophoretically assisted transfer on the back, and not to influence the recording medium, in particular to allow essentially no shrinkage of the recording medium to occur.

The problem is solved by treating the simplex print image with liquid droplets and/or steam. For this purpose, the unfixed print image is exposed to liquid droplets and/or steam on a first side of the recording medium, for example over a particular path.

In addition to the possible formation of a protective film on the print image, the liquid droplets and/or liquid droplets from the steam, for example from water vapour, are deposited by application or spraying in the toner/carrier layer and can therefore reduce electrophoretic mobility in the unfixed layer.

If the simplex print image of the front, to which image liquid droplets, for example water droplets, have been added, is now fed to the duplex printing unit, retransfer onto the components of the duplex printing apparatus, for example onto a pressure roller, by the influence of an electric field is reduced to an acceptable amount.

Advantageous configurations and developments emerge from the further dependent claims and from the description with reference to the figures of the drawings.

BRIEF DESCRIPTION OF THE DRAWINGS

The present invention will be described below with reference to the embodiments indicated in the schematic figures of the drawings, in which.

Figure 1:
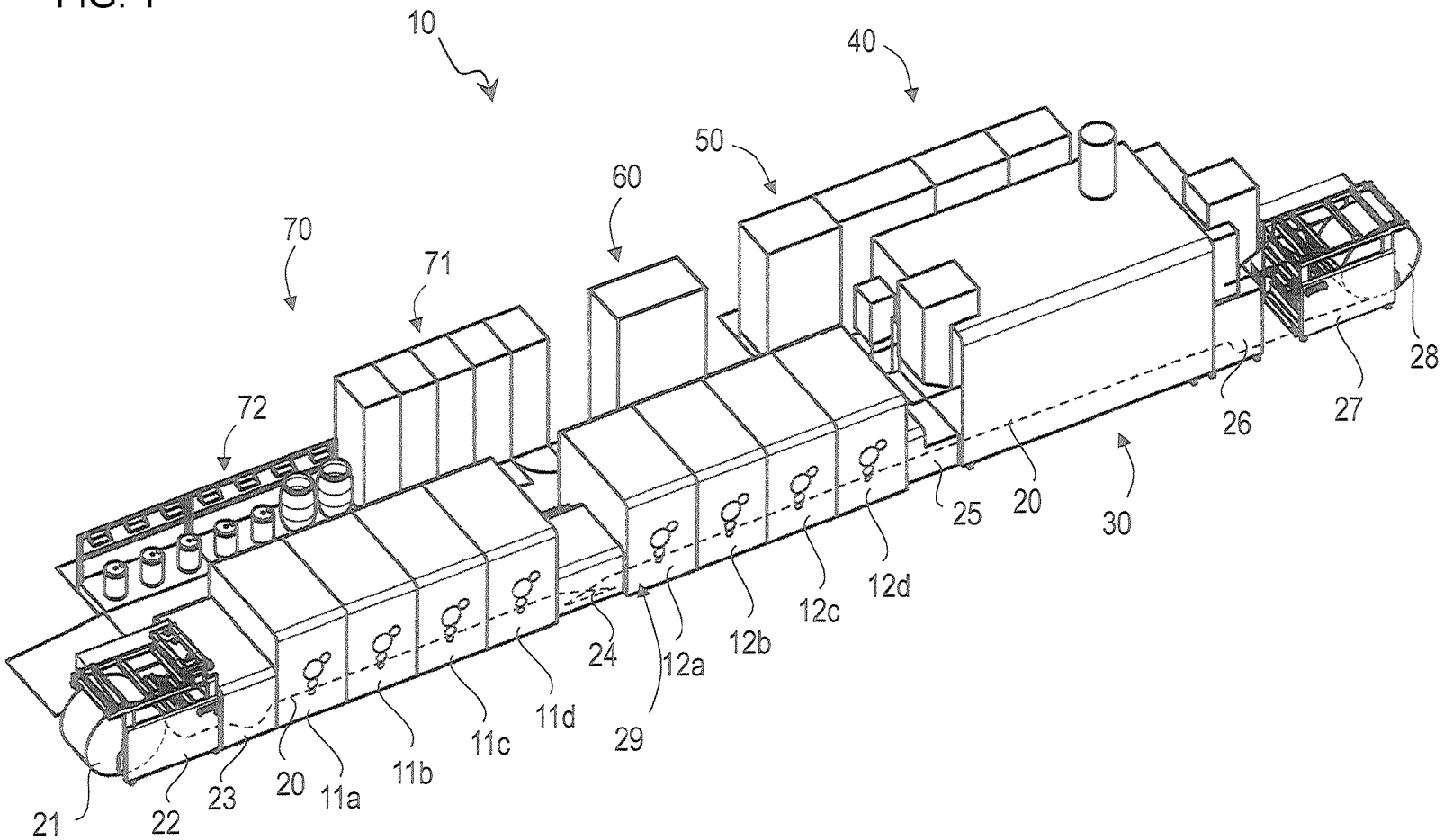
FIG. 1 is a view of a digital printer in the case of an exemplary configuration of the digital printer.

The elements in the drawings are not necessarily shown true to scale in relation to one another.

In the figures of the drawings, elements, features and components which are like, functionally like or have a like effect are each provided with the same reference numerals, unless indicated otherwise.

DETAILED DESCRIPTION

First, in the context of the present patent application, the following terms are to be understood as follows:

In the context of the invention, a simplex printing apparatus denotes a device within which an image is applied to a first side of a recording medium by a printing material.

A duplex printing apparatus denotes a device within which an image is applied to a second side of the recording medium, which is opposite the first side of the recording medium, by a printing material, such that a printing material has been applied to the two sides of the recording medium after passage through the duplex printing apparatus.

In the context of the invention, steam is a gas formed from a liquid, optionally also in conjunction with other gases such as air, which may even still contain very fine droplets from the liquid. In addition, the term steam also encompasses aerosols or fog, i.e. very fine liquid droplets in a gas such as air. Particularly preferably, the term "steam" does not encompass superheated steam. In a preferred embodiment the steam has a temperature which is lower than the boiling temperature of the liquid contained therein. For example, said temperature is below 100° C. in the case of water vapour or an aerosol/fog comprising water droplets.

Polar fluids such as formamide, dimethyl sulphoxide (DMSO), water, alcohols such as methanol, ethanol, propanol, etc., carbonic acids, and so on, possibly containing preferably polar solids such as urea, are preferably used as liquids in the context of the invention. Preferred polar fluids have a boiling point of above 40° C., more preferably of above 50° C., particularly preferably of above 60° C. and, more preferably, are also transparent. Polar protic liquids, in particular water, are particularly preferred.

Liquid droplets are small droplets of a liquid having a temperature below the boiling point of the liquid. The liquid droplets may be formed from, for example, the gas phase by condensation or spraying from, for example, a nozzle, screen, etc., or by another suitable means by which to produce liquid droplets.

In the context of the invention, water droplets are liquid droplets of water having a temperature below the boiling point of water, for example 100° C. at normal pressure, which are present in the form of a drop. In particular, water in solid form or gaseous form is not encompassed by this term.

Conditioning can lead to intermediate fixing. In the context of the invention, intermediate fixing means that fixing takes place spatially between the printing in a simplex printing apparatus and the printing in a duplex printing apparatus. In this connection, however, intermediate fixing is also to be understood in contrast to fixing in which the print image/the particles on the recording medium are fixed thereto, for example by melting. In contrast, the intermediate fixing in the context of the invention includes an improvement in the adhesion of a printing material, for example a printing liquid and/or of particles contained therein, to the recording medium, without resulting in fixing of the printing material on the surface of the recording medium.

The invention relates to a printing arrangement for two-sided printing on a recording medium, and in particular to a digital printer for printing on a recording medium using toner particles which are applied by a liquid developer, preferably a high-speed printer for printing on recording media, more preferably recording media in web or sheet form.

In the case of digital printers, a latent charge image of a charge image carrier is inked, in certain embodiments by a liquid developer by electrophoresis. The resulting image is transferred to the recording medium directly or indirectly via a transfer element. The liquid developer used in certain embodiments may comprise toner particles and carrier liquid in a desired ratio. Mineral oil is preferably used as carrier liquid. In order to provide the toner particles with an electrostatic charge, charge control agents are added to the liquid developer in certain embodiments. In addition, further additives may be added in order for example to obtain the desired viscosity or desired drying properties of the liquid developer.

In the case of two-sided printing, an image is applied to the recording medium on a first side or front and also subsequently to a second side or back, which is opposite the first side.

Prior to the application on the second side, the image is fixed on the first side according to the prior art, as indicated above, in order to prevent removal onto an impression roller in the duplex printing apparatus, although this is associated with the above-mentioned problems.

The problems are solved by exposing the simplex print image to liquid droplets and/or steam. For this purpose, the unfixed print image is exposed to liquid droplets and/or steam on the first side, for example over a particular path. Thus, the exposure to liquid droplets and/or steam, e.g. resulting from spraying and/or heating water, happens particularly prior to the final fixation of the recording medium.

The steam and/or liquid droplets is/are applied according to the present invention using a conditioner, in such a way that the recording medium is exposed to the steam and/or liquid droplets. The exposure to steam and/or liquid droplets may lead to a reduction in the mobility of the printing material as a result of liquid droplets and/or liquid droplets from the steam entering the printing material. In addition, poor adhesion to a pressure roller or impression roller (back roller) results due to the liquid droplets and/or liquid droplets from the steam forming a superficial protective surface on the printing material.

If the simplex print image of the front, which image has been exposed to liquid droplets, is then fed to the duplex printing unit, retransfer onto the pressure roller by the influence of an electric field is reduced to an acceptable amount.

Figure 2:
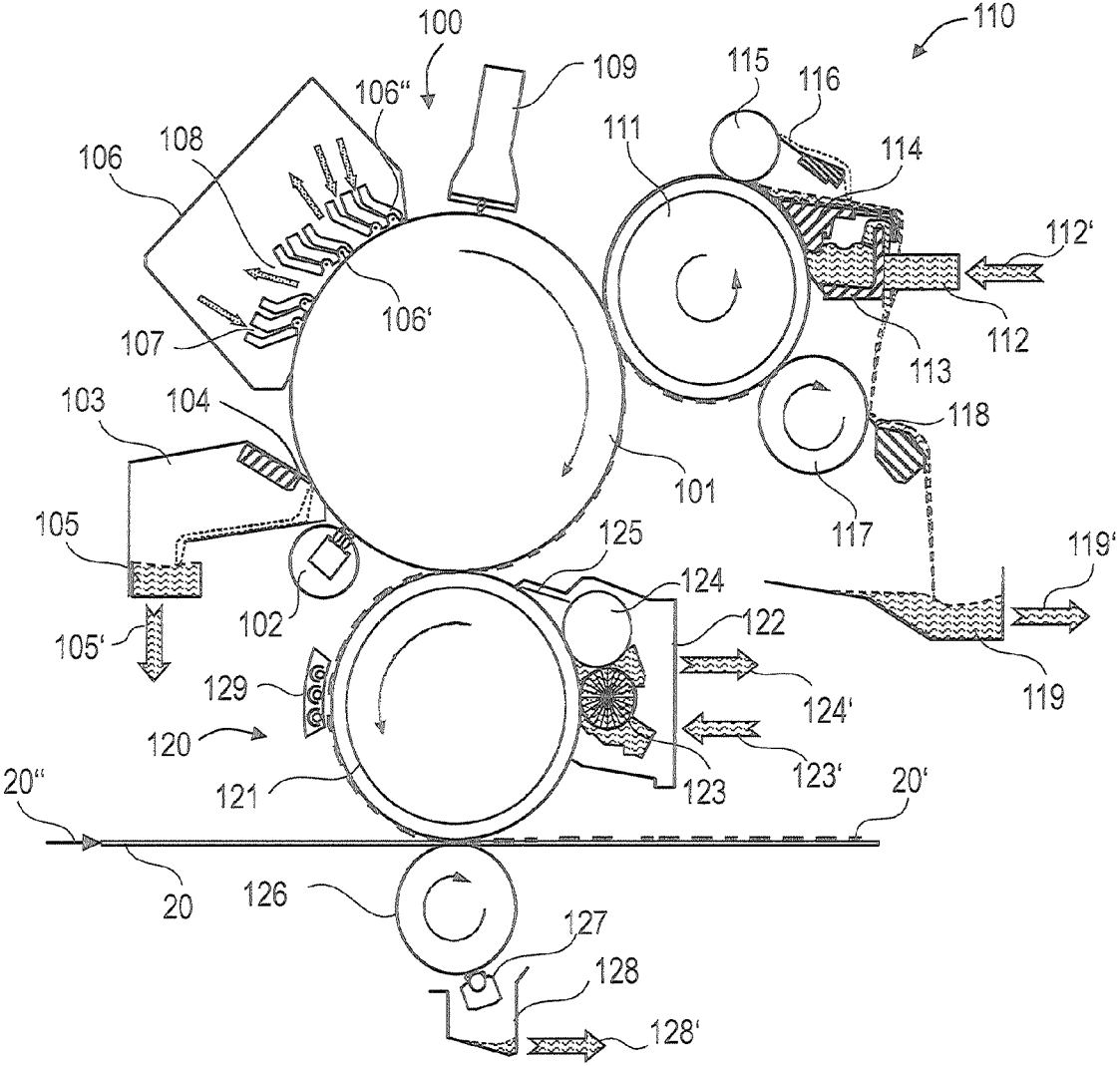
FIG. 2 shows a schematic construction of a printing unit of the digital printer according to FIG. 1.

An exemplary printing arrangement for two-sided printing is shown in FIGS. 1 and 2 by way of a digital printer, although the printing arrangement according to the invention is not limited to such digital printers.

According to FIG. 1, a digital printer 10 for printing on a recording medium 20 comprises one or more printing units 11*a*-11*d* (simplex printing apparatus 11) and 12*a*-12*d* (duplex printing apparatus 12) which print a toner image (print image 20'; see FIG. 2) on the recording medium 20. As recording medium 20, a recording medium 20 in web form can, as shown, be unwound from a reel 21 by an unwinder 22 and fed to the first printing unit 11*a*. The print image 20' is fixed on the recording medium 20 in a final fixing apparatus 30. The recording medium 20 can then be wound onto a reel 28 by a rewinder 27. Such a configuration is also known as a reel-to-reel printer. In order to expose the image to steam and/or liquid droplets downstream of the simplex printing apparatus 11, a conditioner 29 is provided subsequent to a turning device 24, in which conditioner the printed first side of the recording medium 20 is exposed to liquid droplets and/or steam 300.

In the preferred configuration shown in FIG. 1, the recording medium 20 in web form is printed on in full colour by four printing units 11*a* to 11*d* on the front and by four printing units 12*a* to 12*d* on the back (what is known as a 4/4 configuration). For this purpose, the recording medium 20 is unwound from the reel 21 by the unwinder 22 and fed to the first printing unit 11*a* via an optional conditioning mechanism 23. In the conditioning unit 23 the recording medium 20 can be pretreated or coated with a suitable substance. In certain embodiments, wax or chemically equivalent substances can preferably be used as a coating substance (also referred to as primer). However, coating the recording medium 20 is not absolutely necessary and may be omitted in certain embodiments.

The coating substance may be applied over the entire surface of the recording medium 20 or only to the areas subsequently to be printed on, in order to prepare the recording medium 20 for printing and/or to influence the absorption behaviour of the recording medium 20 upon application of the print image 20'. The subsequently applied printing material, for example toner particles or a carrier liquid, is thus prevented from penetrating into the recording medium 20 too much, and instead remains substantially on the surface (thus improving colour and image quality).

The recording medium 20 is then fed in turn to the first printing units 11*a* to 11*d*, in which only the front is printed on. Each printing unit 11*a*-11*d* usually prints on the recording medium 20 in a different colour or else with a different toner material, for example MICR toner, which can be read electromagnetically.

After the printing on the front, the recording medium 20 is turned in a turning device 24, exposed to steam and/or liquid droplets in the conditioner 29 and fed to the remaining printing units 12*a*-12*d* for printing on the back. The conditioning prepares the recording medium 20 for back printing and prevents the front print image from being damaged mechanically during further transport through the subsequent printing units.

In order to achieve full-colour printing, at least four colours (and thus at least four printing units 11, 12) are required, and specifically for example the basic colours YMCK (yellow, magenta, cyan and key). Further printing units 11, 12 using special colours (for example, client-specific colours or additional basic colours, in order to extend the printable colour space) can also be used.

A register unit 25 is arranged downstream of the printing unit 12*d* and evaluates register marks which are printed on the recording medium 20 independently of the print image 20' (in particular outside the print image 20'). The transverse and longitudinal register (the basic colour dots which form a colour dot should be arranged on top of one another or spatially very close to one another; this is also known as colour register or four-colour register) and the register (front and back must coincide precisely in space) can thus be adjusted, in order to achieve a qualitatively good print image 20'.

The final fixing apparatus 30 is arranged downstream of the register unit 25 and fixes the print image 20' onto the recording medium 20. In the case of electrophoretic digital printers, a thermal dryer, which largely evaporates the carrier liquid so that only the toner particles remain on the recording medium 20, is preferably used as a final fixing apparatus 30. This happens under the effect of heat. In this connection, the toner particles may also be melted onto the recording medium 20 if they comprise a material which is meltable under the effect of heat, for example resin. Alternatively, fixing can also take place using superheated steam, i.e. using steam in the superheated state, which is devoid of condensation nuclei.

A draw unit 26 is arranged downstream of the final fixing apparatus 30 and draws the recording medium 20 through all the printing units 11*a*-12*d* and the final fixing apparatus 30 without a further drive being arranged in this region, as a friction drive for the recording medium 20 would involve the risk of blurring the as yet unfixed print image 20'.

The draw unit 26 feeds the recording medium 20 to the rewinder 27, which rolls up the printed recording medium 20.

Arranged centrally next to the printing units 11, 12 and the final fixing apparatus 30 are all the supply apparatuses for the digital printer 10, such as air conditioning modules 40, power supply 50, controller 60, liquid management modules 70, such as liquid control unit 71 and reservoirs 72 for the various liquids. In particular, pure carrier liquid, highly concentrated liquid developer (high toner particle content in relation to the carrier liquid) and serum (liquid developer plus charge control agents) can be used as liquids for supplying the digital printer 10. Waste containers for liquids to be disposed of or containers for cleaning liquid are also provided.

The digital printer 10 with its identically constructed printing units 11, 12 is constructed in a modular manner. The printing units 11, 12 do not differ mechanically but merely in terms of the liquid developer contained therein (toner colour or toner type).

The basic construction of a printing unit 11, 12 is shown in FIG. 2. Such a printing unit is based on the electrophotographic principle by which a photoelectric image carrier is inked by a liquid developer with charged toner particles and the resulting image is transferred to the recording medium 20.

The printing unit 11, 12 basically consists of an electrophotography station 100, a developer station 110 and a transfer station 120.

At the core of the electrophotography station 100 is a photoelectric image carrier which comprises a photoelectric layer (known as a photoconductor) at its surface. In this case, the photoconductor is designed as a roller (photoconductor roller 101) and has a hard surface. The photoconductor roller 101 rotates past the various elements to produce a print image 20' (rotation in the direction of the arrow).

The photoconductor is firstly cleaned of all impurities. For this purpose, an erasing light 102 is provided which erases the charges remaining on the surface of the photoconductor. The erasing light 102 is adjustable (locally variable) in order to achieve a homogeneous light distribution. The surface can thus be pretreated uniformly.

After the erasing light 102, a cleaning apparatus 103 cleans the photoconductor mechanically in order to remove toner particles which may still present on the surface of the photoconductor, possibly dirt particles and remaining carrier liquid. The carrier liquid which is cleaned off is fed to a collecting container 105. The collected carrier liquid and toner particles are processed (optionally filtered) and, depending on colour, fed to a corresponding liquid ink supply, that is to say one of the reservoirs 72 (cf. arrow 105').

The cleaning apparatus 103 preferably comprises a blade/scraper 104 which rests at an acute angle (approximately 10° to 80° to the delivery surface) against the outer face of the photoconductor roller 101 in order to clean the surface mechanically. The blade 104 can move back and forth at right angles to the direction of rotation of the photoconductor roller 101 in order to clean the outer face over the entire axial length with as little wear as possible.

The photoconductor is then charged at a predetermined electrostatic potential by a charging device 106. A plurality of corotrons (in particular glass-clad corotrons) is preferably provided for this purpose. The corotrons consist of at least a wire 106' to which a high voltage is applied. The voltage ionises the air around the wire 106'. A screen 106" is provided as a counter electrode. Fresh air which is supplied through special air ducts (air supply duct 107 for aeration and exhaust air duct 108 for venting) between the screens (see also air flow arrows in FIG. 2) also flows around the corotrons. The supplied air is then ionised uniformly at the wire 106'. As a result, homogeneous, uniform charging of the adjacent surface of the photoconductor is achieved. The uniform charging can be improved further by using dry and heated air. Air is removed via the exhaust air ducts 108. Any resulting ozone can also be drawn off via the exhaust air ducts 108.

The corotrons are cascadable, that is to say there are then two or more wires 106' per screen 106" at the same screen voltage. The current which flows across the screen 106" is variable and the charging of the photoconductor is thus controllable. Current can flow through the corotrons at different strengths in order to achieve uniform and sufficiently high charging of the photoconductor.

A character generator 109 is arranged downstream of the charging device 106 and discharges the photoconductor pixel by pixel via optical radiation according to the desired print image 20'. This results in a latent image which is subsequently inked with toner particles (the inked image corresponds to the print image 20'). Preferably, an LED character generator 109 is used in which an LED row comprising many individual LEDs is arranged in a stationary manner over the entire axial length of the photoconductor roller 101. The number of LEDs and the size of the optical imaging points on the photoconductor determine inter alia the resolution of the print image 20' (typical resolution is 600×600 dpi). The LEDs can be controlled individually in time and in terms of their radiant power. Thus, multilevel methods can be used to produce dots (consisting of a plurality of picture elements or pixels) or picture elements can be delayed in order to carry out corrections electro-optically, for example in the case of incorrect colour register or register.

The character generator 109 comprises a drive logic which must be cooled owing to the large number of LEDs and the radiant power thereof. The character generator 109 is preferably liquid-cooled. The LEDs can be driven in groups (a plurality of LEDs combined to form a group) or separately from one another.

The latent image produced by the character generator 109 is inked with toner particles by the developer station 110. For this purpose, the developer station 110 comprises a rotating developer roller 111 which introduces a layer of liquid developer onto the photoconductor (the mode of operation of the developer station 110 will be described in detail below). Since the surface of the photoconductor roller 101 is relatively hard, the surface of the developer roller 111 is relatively soft and the two are pressed against one another, a thin, tall nip (a gap between the rollers) is produced, in which the charged toner particles migrate electrophoretically from the developer roller 111 to the photoconductor in the image areas owing to an electric field. In the non-image areas, no toner passes onto the photoconductor. The nip filled with liquid developer has a height (thickness of the gap) which is dependent on the mutual pressure of the two rollers 101, 111 and the viscosity of the liquid developer. The thickness of the nip is typically in the range from greater than approximately 2 μm to approximately 20 μm (the values can also vary depending on the viscosity of the liquid developer). The length of the nip is approximately a few millimeters.

The inked image rotates with the photoconductor roller 111 to a first transfer point in which the inked image is transferred substantially completely onto a transfer roller 121. At the first transfer point (nip between photoconductor roller 101 and transfer roller 121), the transfer roller 121 moves in the same direction as and preferably at an identical speed to the photoconductor roller 101. After the transfer of the print image 20' onto the transfer roller 121, the print image 20' (toner particles) can optionally be recharged or charged by a charging unit 129, for example a corotron, in order for the toner particles to be transferred better onto the recording medium 20 afterwards.

The recording medium 20 passes in the transport direction 20" between the transfer roller 121 and an impression roller 126. The contact region (nip) represents a second transfer point where the toner image is transferred onto the recording medium 20. In the second transfer region, the transfer roller 121 moves in the same direction as the recording medium 20. The impression roller 126 also rotates in this direction in the region of the nip. The speeds of the transfer roller 121, the impression roller 126 and the recording medium 20 are coordinated and preferably identical at the transfer point, in order not to smudge the print image 20'. At the second transfer point, the print image 20' is transferred onto the recording medium 20 electrophoretically owing to an electric field between the transfer roller 121 and the impression roller 126. Moreover, the impression roller 126 presses against the relatively soft transfer roller 121 with a large mechanical force, whereby the toner particles also stick to the recording medium 20 owing to adhesion.

Since the surface of the transfer roller 121 is relatively soft and the surface of the impression roller 126 is relatively hard, upon rolling a nip is produced in which the toner transfer takes place. Unevennesses of the recording medium 20 can thus be compensated for, such that the recording medium 20 can be printed on without gaps. Such a nip is also well suited for printing on relatively thick or relatively uneven recording media 20, as is the case for example in packaging printing.

Although the print image 20' should pass completely onto the recording medium 20, a few toner particles may undesirably remain on the transfer roller 121. Some of the transfer liquid always remains on the transfer roller 121 owing to wetting. The toner particles which may remain should be removed virtually completely by a cleaning unit 122 downstream of the second transfer point. The carrier liquid remaining on the transfer roller 121 can also be removed from the transfer roller 121 completely or to a predetermined layer thickness in order that, downstream of the cleaning unit 122 and upstream of the first transfer point from the photoconductor roller 101 onto the transfer roller 121, the same conditions prevail owing to a clean surface or a defined layer thickness of liquid developer on the surface of the transfer roller 121.

This cleaning unit 122 is preferably designed as a wet chamber comprising a cleaning brush 123 and a cleaning roller 124. In the region of the brush 123, cleaning liquid (for example, carrier liquid or a separate cleaning liquid can be used) is supplied via a cleaning liquid inlet 123'. The cleaning brush 123 rotates in the cleaning liquid and "brushes" the surface of the transfer roller 121. The toner adhering to the surface is loosened as a result.

The cleaning roller 124 is at an electrical potential which is opposed to the charge of the toner particles. As a result, the electrically charged toner is removed from the transfer roller 121 by the cleaning roller 124. Since the cleaning roller 124 touches the transfer roller 121, it also removes carrier liquid remaining on the transfer roller 121 together with the supplied cleaning liquid. A conditioning element 125 is arranged at the outlet of the wet chamber. As shown, a retaining plate which is arranged at an obtuse angle (for example between 100° and 170° between plate and delivery surface) to the transfer roller 121 can be used as a conditioning element 125, whereby residues of liquid on the surface of the roller in the wet chamber are held back virtually completely and fed to the cleaning roller 124 for removal via a cleaning liquid drain 124' to a cleaning liquid reservoir (not shown, among the reservoirs 72).

Instead of the retaining plate, a metering unit (not shown), which for example comprises one or more metering rollers, can also be arranged there. The metering rollers are at a predetermined distance from the transfer roller 121 and remove a quantity of carrier liquid such that a predetermined layer thickness is set downstream of the metering rollers owing to the squeezing. The surface of the transfer roller 121 is then not completely cleaned; carrier liquid remains over the entire surface to a predetermined layer thickness. Removed carrier liquid is recycled to the cleaning liquid reservoir via the cleaning roller 124.

The cleaning roller 124 itself is kept clean mechanically by a blade/scraper (not shown). Cleaned-off liquid, including toner particles, is collected for all colours by a central collecting container, cleaned and fed to the central cleaning liquid reservoir for recycling.

The impression roller 126 is also cleaned by a cleaning unit 127. As a cleaning unit 127, a blade/scraper, a brush and/or a roller can remove impurities (paper dust, toner particle residue, liquid developer, etc.) from the impression roller 126. The cleaned liquid is collected in a collecting container 128 and supplied to the printing process again via a liquid drain 128', optionally in a cleaned state. The cleaning can be done dry or by washing liquid (carrier/serum).

In the printing units 11 which print on the front of the recording medium 20, the impression roller 126 presses against the unprinted side (and thus the side which is still dry) of the recording medium 20.

Nevertheless, there may be dust/paper particles or other dirt particles on the dry side which are then removed by the impression roller 126. For this purpose, the impression roller 126 should be wider than the recording medium 20. As a result, impurities outside the print region can also be cleaned off effectively.

In the printing units 12 which print on the back of the recording medium 20, the impression roller 126 presses directly on the damp print image 20' of the front, which has not yet been fixed. In order for the print image 20' not to be removed by the impression roller 126, the surface of the impression roller 126 can in certain embodiments have non-stick properties with regard to toner particles and also with regard to the carrier liquid on the recording medium 20, and/or against liquid droplets from the steam and/or the liquid droplets.

The developer station 110 inks the latent print image 20' with a predetermined toner. For this purpose, the developer roller 111 introduces toner particles onto the photoconductor. In order to ink the developer roller 111 itself with an all-over layer, liquid developer is firstly fed in a predetermined concentration from a mixing container (not shown, inside the liquid control unit 71) to a supply chamber 112 via a liquid inlet 112'. From this supply chamber 112, the liquid developer is fed in abundance to an antechamber 113 (a type of upwardly open trough). An electrode segment 114 is arranged towards the developer roller 111 and forms a gap between itself and the developer roller 111.

The developer roller 111 rotates through the upwardly open antechamber 113 and carries liquid developer along into the gap. Excess liquid developer passes from the antechamber 113 back to the supply chamber 112.

Owing to the electric field formed between the electrode segment 114 and the developer roller 111 owing to the electrical potentials, the liquid developer in the gap is distributed into two regions, specifically a layer region in the vicinity of the developer roller 111, in which layer region the toner particles are concentrated (concentrated liquid developer), and a second region in the vicinity of the electrode segment 114, which second region is depleted in toner particles (very low-concentration liquid developer).

The layer of liquid developer is then transported on to a metering roller 115. The metering roller 115 squeezes off the upper layer of liquid developer, such that a defined layer thickness of liquid developer of approximately 5 μm thickness remains on the developer roller 111 afterwards. Since the toner particles are located mainly near the surface of the developer roller 111 in the carrier liquid, mainly the carrier liquid on the outside is squeezed off or retained and ultimately recycled to a collecting container 119, but not fed to the supply chamber 112.

As a result, predominantly high-concentration liquid developer is conveyed through the nip between metering roller 115 and developer roller 111. A uniformly thick layer of liquid developer comprising approximately 40 percent by mass toner particles and approximately 60 percent by mass carrier liquid is thus formed downstream of the metering roller 115 (depending on the printing process requirements, the mass ratios may also fluctuate to a greater or lesser extent). This uniform layer of liquid developer is transported into the nip between the developer roller 111 and the photoconductor roller 101. There, the image areas of the latent image are then inked electrophoretically with toner particles, while no toner passes onto the photoconductor in the region of non-image areas. Enough carrier liquid is imperative for electrophoresis. Downstream of the nip the liquid film splits approximately in the middle owing to wetting, such that part of the layer sticks to the surface of the photoconductor roller 101 and the other part (for image areas mainly carrier liquid and for non-image areas toner particles and carrier liquid) remains on the developer roller 111.

In order that the developer roller 111 can be coated with liquid developer again under the same conditions and uniformly, remaining toner particles (these basically represent the negative, non-transferred print image) and liquid developer are removed electrostatically and mechanically by a cleaning roller 117. The cleaning roller 117 itself is cleaned by a blade/scraper 118. The cleaned-off liquid developer is fed to the collecting container 119 for recycling, the liquid developer cleaned from the metering roller 115, for example by a blade/scraper 116, and the liquid developer cleaned from the photoconductor roller 101 by the blade/scraper 104 also being fed to said collecting container.

The liquid developer collected in the collecting container 119 is fed to the mixing container via the liquid drain 119'. Fresh liquid developer and pure carrier liquid are also fed to the mixing container as required. There must always be enough liquid in a desired concentration (predetermined ratio of toner particles to carrier liquid) in the mixing container. The concentration is continuously measured in the mixing container and adjusted in accordance with the supply of the amount of cleaned-off liquid developer and the concentration thereof and the amount and concentration of fresh liquid developer and carrier liquid.

For this purpose, maximum-concentration liquid developer, pure carrier liquid, serum (carrier liquid and charge control agents for controlling the charge of the toner particles) and cleaned-off liquid developer can be fed separately to this mixing container from the corresponding reservoirs 72.

The photoconductor can preferably be designed in the form of a roller or as an endless loop. An amorphous silicon as photoconductor material or an organic photoconductor material (also known as OPC) can be used.

Instead of a photoconductor, other image carriers, such as magnetic, ionisable, etc. image carriers, can also be used which do not operate according to the photoelectric principle but rather on which latent images are impressed electrically, magnetically or in another manner according to other principles and then inked and finally transferred onto the recording medium 20.

LED rows or lasers having corresponding scan mechanics can be used as a character generator 109.

The transfer element can also be designed as a roller or as an endless loop. The transfer element can also be omitted. The print image 20' is then transferred directly from the photoconductor roller 101 onto the recording medium 20.

The term "electrophoresis" is understood to mean the migration of the charged toner particles in the carrier liquid owing to the effect of an electric field. Upon each transfer of toner particles, the corresponding toner particles pass substantially completely onto another element. After contacting of the two elements, the liquid film is split approximately in half owing to the wetting of the elements involved, such that approximately half sticks to the first element and remainder sticks to the other element. The print image 20' is transferred and then transported on in the next part in order to allow electrophoretic migration of the toner particles again in the next transfer region.

The digital printer 10 can comprise one or more printing units for the front printing and optionally one or more printing units for the back printing. The printing units can be arranged in a line, in an L shape or in a U shape.

Instead of the rewinder 27, finishing apparatuses (not shown) such as cutters, folders, stackers, etc., can also be arranged downstream of the draw unit 26 in order to bring the recording medium 20 into the final form. For example, the recording medium 20 could be processed to the extent that a finished book is produced at the end. The finishing equipment could also be arranged in line or offset therefrom.

As described above as a preferred embodiment, the digital printer 10 can be operated as a reel-to-reel printer. It is also possible to cut the recording medium 20 into sheets at the end and then to stack the sheets or process them in a suitable manner (reel-to-sheet printer). It is also possible to feed a recording medium 20 in sheet form to the digital printer 10 and to stack or process the sheets at the end (sheet-to-sheet printer).

Depending on the desired print image 20' on the front and back (duplex printing), the printer configuration includes a corresponding number of printing units for front and back, each printing unit 11, 12 always being set up only for one colour or one type of toner.

The maximum number of printing units 11, 12 is only technically limited by the maximum mechanical tensile loading of the recording medium 20 and the free gauge length. Typically, any desired configurations are possible, from a 1/0 configuration (only one printing unit for the front to be printed on) up to a 6/6 configuration, in which six printing units are provided for the front and six for the back of the recording medium 20. The preferred embodiment (configuration) is shown in FIG. 1 (a 4/4 configuration), with which full-colour printing is executed for the front and the back using the four basic colours. The sequence of printing units 11, 12 in four-colour printing preferably goes from a printing unit 11, 12 which prints light (yellow) to a printing unit 11, 12 which prints dark, that is to say for example the recording medium 20 is printed on from light to dark in the colour sequence Y-C-M-K.

The recording medium 20 can be made of paper, metal, plastics material or other suitable materials which can be printed on.

Figure 3:
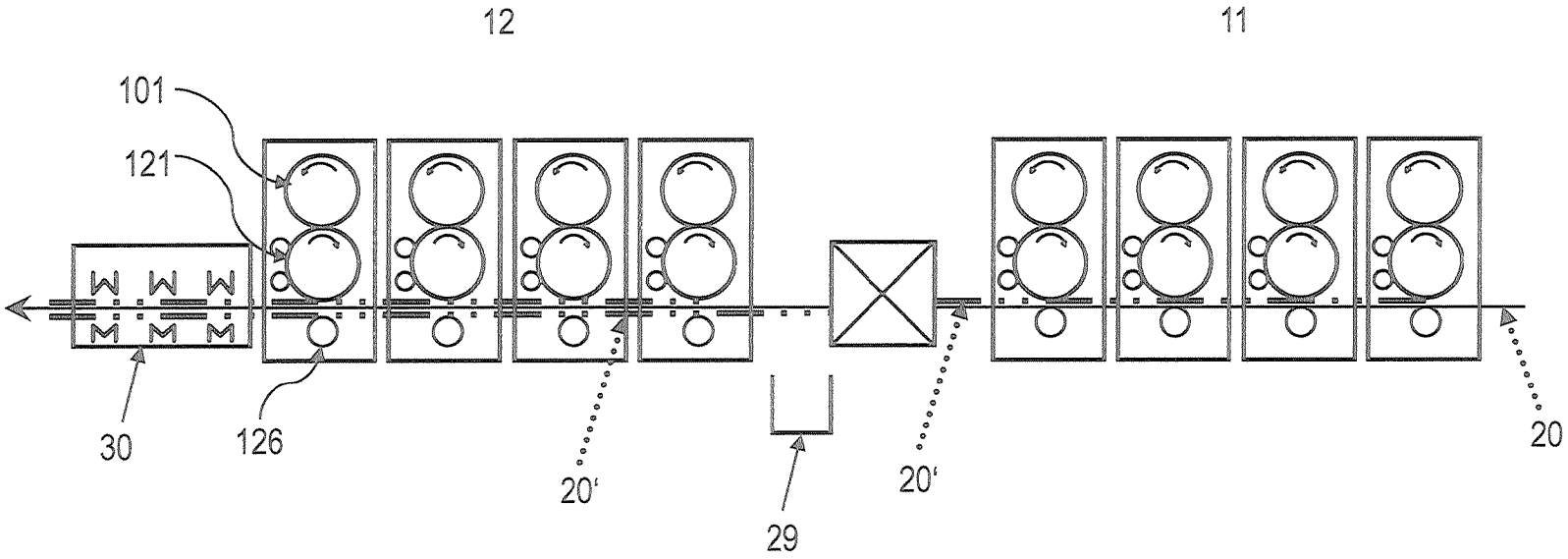
FIG. 3 shows a schematic construction of the digital printer according to FIG. 1.

A simpler view of the simplex printing apparatus 11, the duplex printing apparatus 12, the turning device 24 and the conditioner 29 is shown schematically in FIG. 3, the recording medium 20 being fed into the printing arrangement from right to left.

FIG. 3 shows an embodiment of the present printing arrangement for two-sided printing in which the conditioning by steam 300 takes place downstream of the turning device 24. It is also possible for the conditioning to take place by the additional means of liquid droplets or by liquid droplets instead of steam. Moreover, it is not impossible for the conditioning to take place upstream of the turning device 24 subsequent to the simplex printing apparatus 11 or inside the turning device. However, it is preferred if the conditioning does not take place in the turning device 24, meaning that it takes place either between the simplex printing apparatus 24 and the turning device 24 or between the turning device 24 and the duplex printing apparatus 12, since the conditioner 29 can then be inserted easily between the respective devices without the need to retrofit the turning device 24. In this way it is also easier to monitor the amount of liquid applied to the recording medium 20 by the steam 300 and/or by liquid droplets. Furthermore, FIG. 3 shows the application of the printing material onto the respective sides of the recording medium 20 in the simplex printing apparatus 11 and onto the second side in the duplex printing apparatus 12. The preferred conditioning of the simplex print image by a conditioner 29, which faces the printed side of the recording medium 20 downstream of the simplex printing apparatus 11 and the turning device 24, can also be seen. Treatment by a direct application of the steam 300 and/or liquid droplets on the printed side of the recording medium is thus preferred.

Figure 4:
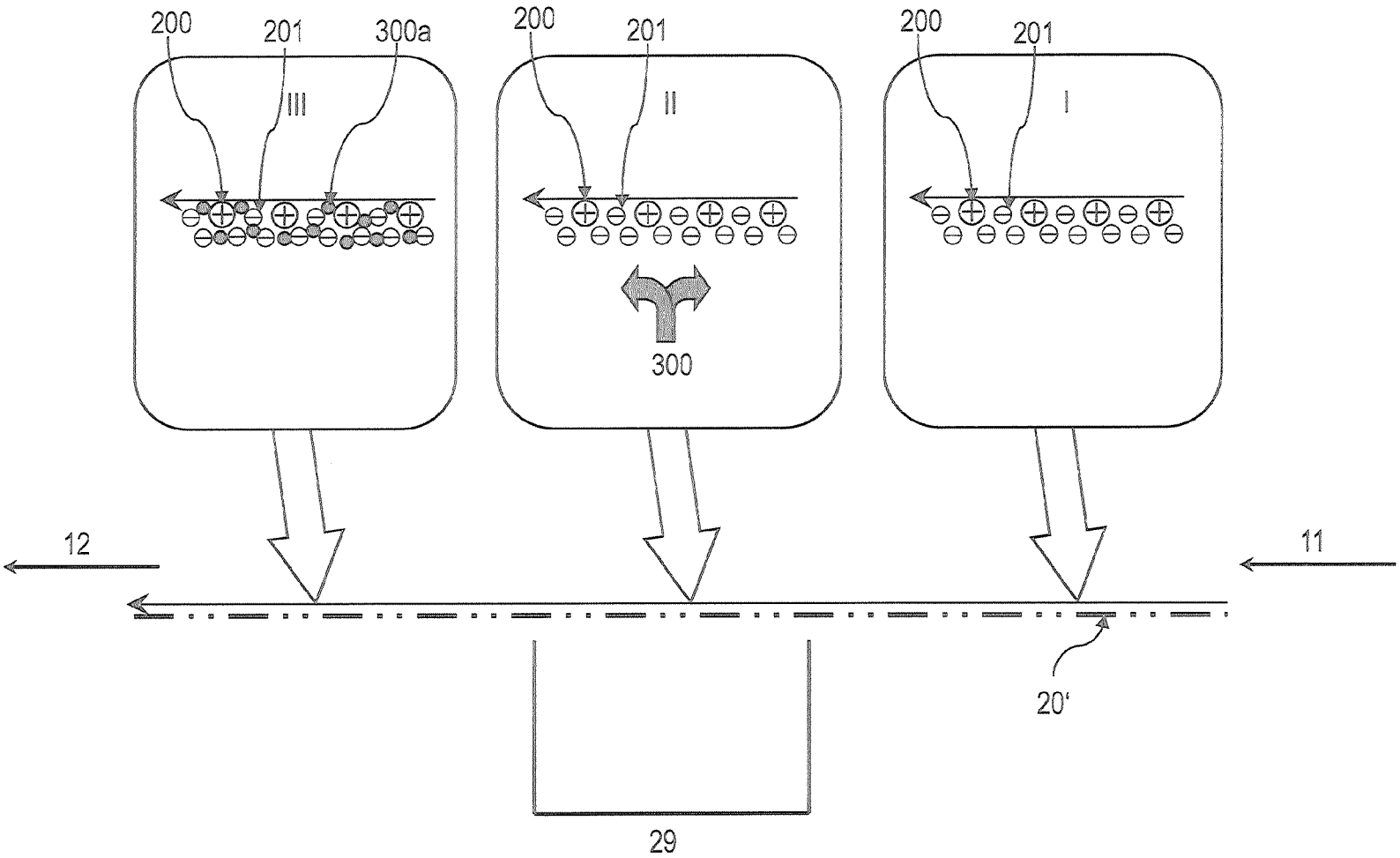
FIG. 4 is a schematic detailed view of the conditioning in a printing arrangement according to the invention.

The conditioning by the steam 300 is shown schematically in FIG. 4, it being possible for a conditioning to take place using liquid droplets either in addition to or instead of the steam. FIG. 4 shows in detail the application of the steam 300 and liquid droplets 300*a* onto and into the printing material, the recording medium 20 being conveyed from right to left in FIG. 4, too.

According to FIG. 4, after the simplex printing in the simplex printing apparatus 11, the printing material is on the underside of the recording medium, for example downstream of a turning device 24, and is brought to the conditioner 29.

In phase I, the not yet intermediately fixed printing material can be seen, which here is represented by way of example by a carrier 200 and toner 201. In phase II, the steam 300 is applied from the conditioning unit 29, particularly—as shown—on the side printed on by the simplex printing apparatus 11. In phase III, liquid droplets 300*a* from the steam 300 are deposited on and in the printing material on the recording medium 20, as a result of which the mobility of the printing material decreases and a protective film forms. The recording medium 20 is subsequently fed to the duplex printing apparatus 12 for printing on the second side of the recording medium 20. As set out above, such an effect can also be achieved by using liquid droplets instead of or in addition to steam 300 from the conditioner 29. When liquid droplets from the conditioner 29 are used, these can be stored directly as liquid droplets 300*a* in the printing material.

Upon application of the liquid droplets 300*a*, preferably water droplets, a protective film of a liquid, preferably water, can be formed on the printing material and/or the recording medium 20, especially by providing the liquid droplet 300*a* and/or steam on the side which was printed on by the simplex printing apparatus, which protective film prevents the print image being damaged by the impression roller 126 during further printing in the duplex printing apparatus 12. In certain embodiments it is possible for such a protective film to pass unscathed through a plurality of printing units. It is thus possible for a protective film, for example an aqueous protective film, to be observed on the recording medium even by the naked eye during the back printing.

In addition to a protective film on the print image, as a result of the application of the liquid droplets 300*a*, these can also be deposited directly in the printing material, for example in a toner/carrier layer as shown in FIG. 4, and thus additionally reduce the electrophoretic mobility of the toner particles (printing ink) in the unfixed toner layer. Although the conditioning in FIG. 4 is shown with a toner/carrier layer, it is also possible for another printing material, such as hydrophobic liquid printing inks or printing particles, to be used which is likewise granted immunity to or protection from electric fields by the liquid from the steam and/or liquid droplets, such as water.

In certain embodiments the application of the liquid droplets 300*a* leads to no further adhesion among the printing materials, such as a conglutination of toner particles, as is normal in the event of thermal fixing.

In preferred embodiments, when charge control agents (CCA) are used in a carrier liquid of the printing material in, for example, digital printers, as set out above, a further effect of stabilisation can occur in that, after application by the conditioner 29, a polar protic liquid such as water, originating from the steam and/or the liquid droplets, dissociates from the charge control agents provided with a charge as a result of the printing operation. In this connection, a charged charge control agent $CCA^-$ can for example react with the hydronium ions $H_3O^+$ resulting from the self-dissociation of water.

The charge control agents, which usually stick to printing material particles, for example a toner, during printing and thus impart a charge thereto, become neutral as a result, such that the charge of the printing material particles is also reduced, for example also in connection with a migration of the charge control agents from the surface of the printing material particles into the carrier liquid. As a result, when an electric field is used between the transfer roller 121 and the impression roller 126 for printing on the second side, such "discharged" toner particles of the print image on the first side are thus no longer influenced by the field—that is to say, the electrophoretic mobility of the toner particles decreases—and therefore they also cannot be drawn onto the impression roller.

Alternatively, it is also conceivable for protons from the surface of printing material particles to react with hydroxide ions $OH^-$, and this can likewise lead to a reduction in the charge of the printing material particles.

The effect of the charge neutralisation increases with increasing temperature, it also nevertheless being possible for non-preferred penetration of the carrier into the recording medium to take place owing to the reduction in the viscosity, and therefore a suitable temperature for the steam application should be suitably selected depending on the carrier liquid, the material of the steam and/or liquid droplets, the charge control agents, the recording medium, etc. In this connection, suitable parameters such as the application temperature of the steam 300 and/or liquid droplets can be determined by simple experiments.

Owing to the dissociation, the pH also drops, and this likewise reduces the electrophoretic mobility.

It is also conceivable for the water to penetrate the toner/carrier layer through the application, such that this layer then becomes electrically conductive and an electric field no longer has an effect on it.

In certain embodiments it is possible for the recording medium to be cooled by a cooling apparatus subsequent to conditioning. This is particularly advantageous if the steam 300 and/or the liquid droplets from the conditioner 29 and/or the liquid droplets 300*a* have a higher temperature than the ambient temperature in the printing arrangement and/or than the recording medium 20.

The steam 300 and/or the liquid droplets are applied to the recording medium 20 in the form of a fog in certain embodiments, which can be achieved e.g. by arranging a plurality of nozzles in the conditioner 29, which nozzles spray pressurised water. In preferred embodiments a compression device is provided in the conditioner 29, by which compression device it can be managed that the steam 300 and/or the liquid droplets is/are applied to the recording medium 20 at a pressure which is higher than the ambient pressure. In this connection, the ambient pressure is the prevailing pressure in the printing arrangement at the time of application of the steam 300 and/or liquid droplets. In this connection, an exemplary compression device is a nozzle, for example a pressure nozzle. Owing to pressurised application, it is achieved that, even in the case of high printing speeds, a laminar boundary film on the recording medium, which film is formed after printing by swept-along ambient air owing to the roughness of the recording medium or of the printing material, can be penetrated substantially, preferably completely, by the steam 300 and/or liquid droplets so that the liquid droplets 300*a* can be applied to the printing material and penetrate the printing material.

Preferably, a binary nozzle/binary fuel nozzle is used, with which, for example, water can be sprayed together with a gas, such as air, to generate high pressure in order to penetrate the laminar boundary film on the recording medium.

However, the printing material should not be deformed, for example by printing material particles such as toner, by the pressurised application of the liquid droplets 300*a*.

It is also possible in certain embodiments for the application of the steam 300 and/or liquid droplets to be electrostatically assisted by the introduction of an electric field. This is advantageous particularly with printing speeds exceeding 2 m/s since, above such speeds, application of the steam 300 and/or liquid droplets by pressure alone may be possible only to a lesser extent.

In addition it is possible in certain embodiments, for example in the case of thin/narrow papers and/or print images, to reduce the amount of liquid by controlling, for example by screens, closable nozzles or the like and relative to the amount of liquid for example, the region in which the steam 300 and/or liquid droplets or fluid is/are applied.

The conditioning by steam 300 and/or liquid droplets preferably takes place such that liquid droplets 300*a* are formed which have a size smaller than 5 μm, preferably smaller than 3 μm and more preferably smaller than 1 μm, thereby bringing about improved penetration of the printing material by the liquid droplets 300*a*. Using droplets which are too large might drench the recording medium 20.

In certain embodiments the steam 300 and/or the liquid droplets can be applied at ambient temperature in the printing arrangement, for example at room temperature, e.g. in the region of 20-25° C.

The method can additionally be used for variable printing speeds over the length of the application path of the steam 300 and/or liquid droplets.

In this connection, the amount of steam 300 and/or liquid droplets to be applied can depend on the surface area of the recording medium 20 and on the number of colour separations/printing operations in the simplex printing apparatus 11. The degree of coverage, however, that is to say the surface area of printing material on the recording medium 20, plays only a secondary role or no role.

In particular when applying printing material having mineral oil or similar substances as carrier liquid of the printing material, the number of colour separations can be important, since the amount of carrier liquid increases with each application, thus rendering necessary more steam 300 and/or liquid droplets.

When using nozzles, a maximum steam amount for water vapour of, for example, 3 l/h and per nozzle for an application of 3 ml/m$^2$ results in the case of 4 applications at a printing speed of 1 m/s, one nozzle every 25 cm sufficing in such embodiments. In this arrangement, the spacing of the nozzles relative to the recording medium 20 can be in a range of from 1 to 20 cm in order to form a steam and/or liquid droplets, for example an aerosol, having a sufficient concentration of very fine liquid droplets and to distribute the steam and/or liquid droplets well.

The presence of a liquid such as water as a protective film after the conditioning can be visualised for example by thermography. It is also possible in certain embodiments to determine the uniformity of the applied liquid during conditioning using inline systems by known measurement methods.

The present invention makes it possible to solve in a technically simple and economical manner the problem of protecting the printed first side of a recording medium 20 in the case of two-sided printing on a recording medium 20.

What is more, exposing the recording medium 20 to steam 300 and/or liquid droplets ensures gentle treatment of the recording medium 20 since the recording medium 20 neither shrinks nor stretches. This is particularly the case where hydrophilic or moisture-containing recording media 20 such as paper or cardboard are used together with water vapour.

It is thus preferable for steam 300 and/or liquid droplets to be applied onto and into the printing material during conditioning, especially on the side printed on by the simplex printing apparatus 11, thereby forming liquid droplets 300*a* and a protective film that can e.g. prevent separation/lifting of the printing material from the recording medium 20 afterwards, e.g. when printing on the second side of the recording medium 20. Yet it is also possible for liquid droplets 300*a* to penetrate as far as the surface of the recording medium 20. Preferably, however, little steam 300 or few liquid droplets 300*a* reach the recording medium 20, particularly when using water and hydrophilic recording media 20. In certain embodiments it is, however, preferred for the use of water vapour to prevent water loss in the recording medium 20 through, for example, the application of water in an amount which prevents water from evaporating from the recording medium 20. In this connection, in addition to a conditioner 29 for applying water droplets, there may also be a device for introducing dry gases such as air, in order to precisely regulate the moisture during intermediate fixing.

In addition, in the case of recording media 20 containing certain fibres, the fibres can be prevented from drying out, thereby facilitating the transfer to back printing since the fibres have not been weakened through drying out.

Furthermore, conditioning by steam 300 and/or liquid droplets entails no optical alteration to the print image since the conditioning is contact-free.

The use of a conditioner 29 which uses steam 300 and/or liquid droplets additionally allows for a simpler and more cost-effective construction compared with the use of a conventional fixing station for intermediate fixing. Retrofitting in existing systems is also simple to carry out.

Moreover, the use of water vapour is particularly advantageous in that, as a substance, water is chemically and toxicologically safe and easy to obtain at low cost, which also leads to cost-effective operation.

When using the printing arrangement according to the invention, a printing method can be carried out in which there is no negative effect on the simplex print image during duplex printing, since the simplex print image has previously been exposed to steam 300 and/or liquid droplets, meaning that a protective film forms on the printing material which can help to avoid that the printing material is separated/lifted from the recording medium 20. By using steam 300 and/or liquid droplets, it is also possible to avoid a negative influence on the recording medium 20, for example by thermal intermediate fixing, and therefore the recording medium 20 is also not influenced by the printing method. Further, the wetting of the simplex print image is carried out before the final fixation, further improving the treatment of the recording medium during printing. This results in an improved recording medium 20 printed on two sides, in that a uniformly large print image in the original size of the simplex print image can be obtained on the two sides without there being a negative influence on the material of the recording medium 20.

These effects thus preferably occur when using recording media 20 which are negatively influenced by heat and/or which deteriorate as a result of moisture loss, such as paper and cardboard.

LIST OF REFERENCE NUMERALS

10 digital printer

11, 11*a*-11*d* printing unit (simplex printing apparatus)

12, 12*a*-12*d* printing unit (duplex printing apparatus)
20 recording medium
20' print image (toner)
20" transport direction of the recording medium
21 reel (input)
22 unwinder
23 conditioning unit
24 turning device
25 register unit
26 draw unit
27 rewinder
28 reel (output)
29 conditioner
30 final fixing apparatus
40 air conditioning module
50 power supply
60 controller
70 liquid management
71 liquid control unit
72 reservoir
100 electrophotography station
101 photoconductor roller
102 erasing light
103 cleaning apparatus (photoconductor)
104 blade (photoconductor)
105 collecting container (photoconductor)
105' arrow
106 charging device (corotron)
106' wire
106" screen
107 air supply duct (aeration)
108 exhaust air duct (venting)
109 character generator
110 developer station
111 developer roller
112 supply chamber
112' liquid inlet
113 antechamber
114 electrode segment
115 metering roller (developer roller)
116 blade (metering roller)
117 cleaning roller (developer roller)
118 blade (cleaning roller for the developer roller)
119 collecting container (liquid developer)
119' liquid drain
120 transfer station
121 transfer roller
122 cleaning unit (wet chamber)
123 cleaning brush (wet chamber)
123' cleaning liquid inlet
124 cleaning roller (wet chamber)
124' cleaning liquid drain
125 conditioning element (retaining plate)
126 impression roller
127 cleaning unit (impression roller)
128 collecting container (impression roller)
128' liquid drain
129 charging unit (corotron at transfer roller)
200 carrier
201 toner
300 steam
300*a* liquid droplet
I unfixed recording medium after simplex printing
II application of steam 300
III reduction in mobility by the liquid droplets 300*a*

What is claimed is:

1. A printing method for two-sided printing on a recording medium, in which method two opposing sides of the recording medium are printed on, the method comprising:

providing at least one simplex printing apparatus, at least one duplex printing apparatus and a recording medium to be printed on;

printing on a first side of the recording medium using the simplex printing apparatus;

conditioning the first side of the recording medium, printed on by the simplex printing apparatus, using liquid droplets or steam; and printing on a second side of the recording medium, which second side is arranged opposite the first side which has been printed on by the simplex printing apparatus and treated, using the duplex printing apparatus.

2. The printing method of claim 1, wherein the conditioning takes place using steam containing liquid droplets.

3. The printing method of claim 1, wherein the conditioning takes place using liquid droplets having a size smaller than 5 μm.

4. The printing method of claim 1, wherein the recording medium is cooled after the conditioning.

5. The printing method of claim 1, wherein the recording medium is turned after printing by the simplex printing apparatus and before printing by the duplex printing apparatus, the turning taking place before or after the conditioning.

6. The printing method of claim 1, wherein during conditioning the steam or liquid droplets is applied to the recording medium at a preset pressure.

7. The printing method of claim 6, wherein the preset pressure is above the ambient pressure.

8. A recording medium printed on two sides, produced by the printing method according to claim 1.

9. The printing method of claim 1, wherein a simplex print image is unfixed when the liquid droplets or the steam are applied during conditioning of the first side of the recording medium.

* * * * *